US005529177A

United States Patent [19]

Podd et al.

[11] Patent Number: 5,529,177

[45] Date of Patent: Jun. 25, 1996

[54] HUMIDITY CONTROL DEVICE FOR CONTAINER OR CONTAINER LINER

[76] Inventors: Stephen D. Podd, 112 R.R. 1, North Hero, Vt. 05474; Victor I. Podd, 1678 SW. 20th Ave., Boca Raton, Fla. 33486

[21] Appl. No.: 296,494

[22] Filed: Aug. 26, 1994

[51] Int. Cl.[6] ..... B65D 81/26; B65D 90/04

[52] U.S. Cl. ..... 206/204; 220/1.5; 220/403

[58] Field of Search ..... 206/204, 205, 206/442; 55/385.4; 96/118, 147, 148; 220/1.5, 403

[56] References Cited

U.S. PATENT DOCUMENTS

| | | | |
|---|---|---|---|
| 2,124,503 | 7/1938 | Bradley | 206/442 |
| 3,339,474 | 9/1967 | Lamp, Jr. et al. | 99/271 |
| 3,809,223 | 5/1974 | Kendall | 206/204 |
| 4,516,906 | 5/1985 | Krein | 414/786 |
| 4,583,347 | 4/1986 | Nielson | 53/434 |
| 4,646,914 | 3/1987 | Gipson | 206/204 |
| 4,671,733 | 6/1987 | Krein | 414/786 |
| 4,749,600 | 6/1988 | Cullen et al. | 206/204 |
| 4,801,042 | 1/1989 | Hamada | 206/204 |
| 4,813,791 | 3/1989 | Cullen et al. | 206/204 |
| 4,815,590 | 3/1989 | Peppiatt et al. | 206/204 |
| 4,863,339 | 9/1989 | Krein | 414/786 |
| 4,911,317 | 3/1990 | Schloesser et al. | 220/1.5 |
| 4,913,942 | 4/1990 | Jick | 206/204 |
| 5,028,197 | 7/1991 | Krein et al. | 414/467 |
| 5,037,459 | 8/1991 | Spruill et al. | 206/204 |
| 5,059,084 | 10/1991 | Krien | 414/467 |
| 5,224,332 | 9/1993 | Krein et al. | 414/467 |

*Primary Examiner*—Jimmy G. Foster
*Attorney, Agent, or Firm*—John C. Smith

[57] ABSTRACT

A humidity control system for cargo containers. The humidity is controlled by one or more panels having a supply of desiccant or moisture absorbing material which can be initially installed in the dry state to reduce humidity. The panels can be installed on the ceiling, floor and/or walls of the container. For particular types of cargo which require higher humidity, the panel can be saturated with water prior to transporting the cargo. The saturated panel will release water vapor gradually to maintain a higher humidity. The panel can be a single panel or be made from several smaller panels. The panel can be used with or without a liner. When used with a liner, it can be installed as an integral part of the liner, or as a separate unit which can optionally hold the liner in place for loading and unloading.

26 Claims, 9 Drawing Sheets

Prior Art

HUMIDITY CONTROL DEVICE FOR CONTAINER OR CONTAINER LINER

BACKGROUND OF THE INVENTION

1. Technical Field

The present invention relates to control of humidity lined or unlined bulk cargo containers. In particular, it relates to suspendable moisture absorbant such as desiccant panels which reduce or increase humidity depending on the nature of the cargo.

2. Background Art

Transportation of containers for bulk commodity products (grains, etc.) have been implemented using a variety transport vehicles, such as trucks, railroads, and ships. Initially, containers developed to haul cargo were simple storage devices which did not address environmental concerns. However, due to the long time delays in shipping commodities in large markets, and the nature of many commodity goods, the value of commodities can be significantly reduced. This is true not only for perishable goods such as foods, but also for other goods such as automobiles, electronics, computers, or military equipment which can be subject to damage from rust during shipment from factories or to remote areas with harsh climates. Therefore, an important economic factor in the transportation of commodities is the deterioration of the commodities due to adverse environmental factors, such as humidity.

The prior art has addressed environmental factors in several ways. For example, insulated containers such as those having on-board refrigeration can preserve commodities for longer periods. However, not all commodities are suitable for shipping under refrigeration. In addition, refrigeration containers are expensive manufacture and expensive to operate due to fuel consumption.

Another method of protecting commodities from environmental factors has been the development of liners. While improving on the level of humidity control, liners are limited by their passive nature. Due to the passive nature of liners, and to the substantial changes in humidity that occur as a container is transported through various weather systems, cargo damage due to humidity remains a concern for numerous perishable commodities.

The use of desiccant bags to reduce humidity can be implemented, but desiccant bags create additional problems in that it is undesirable to loosely place these bags in a liner or a container without a liner because they can interfere with the loading and unloading process. The use of many small desiccant bags may also cause the dehumidification process to be localized in certain areas of the cargo, resulting in uneven benefit and reduced usefulness. In addition, the use of loose desiccant bags is undesirable since a leak in one of the loose bags, caused by defect, mishandling, or damage done during shipment, may contaminate certain cargo such as foodstuffs.

It is known that liners can be evacuated after loading by withdrawing air via a pump. In this manner, the liner is compressed around the cargo, much like consumer products are shrink wrapped. A drawback associated with this approach is the expense involved with the evacuation equipment, as well as the extra labor involved to ensure that the liner is properly sealed. Further, since container sized liners are apt to have some small leaks, the pump may have to be transported on the container to periodically restore the vacuum. Of course, since evacuation can only serve to reduce humidity, it is of no use in situations were a higher humidity is desirable.

While addressing the various environmental aspects of transporting bulk commodities in container systems, the prior art has produced various methods such as refrigeration systems which are useful for a subset of the products shipped by container, liners used alone or with loose desiccant bags, or liner evacuation systems. While the prior art approaches solve various problems associated with transportation of bulk cargo, they have not provided an active humidity control system which is easily installed, is inexpensive to use, avoids contamination of cargo, does not interfere with loading or unloading, and can be used to either increase or decrease humidity depending on the nature of the cargo.

SUMMARY OF THE INVENTION

The present invention solves the foregoing problems by providing one or more humidity control panels which can be installed in a dry state to reduce humidity or in a saturated state to increase humidity based on cargo type. The humidity control panel(s) can be installed in a container without a liner or with a liner. The humidity control panel(s) and the liner can be integrated into a single unit.

DESCRIPTION OF THE PREFERRED EMBODIMENT

For ease of discussion, the term desiccant is defined and used throughout this disclosure as describing not only those categories of materials which typically fall in the category of desiccants, but also to describe any suitable moisture holding material which can be substituted to fabricate the humidity control panels discussed below.

Figure 1:
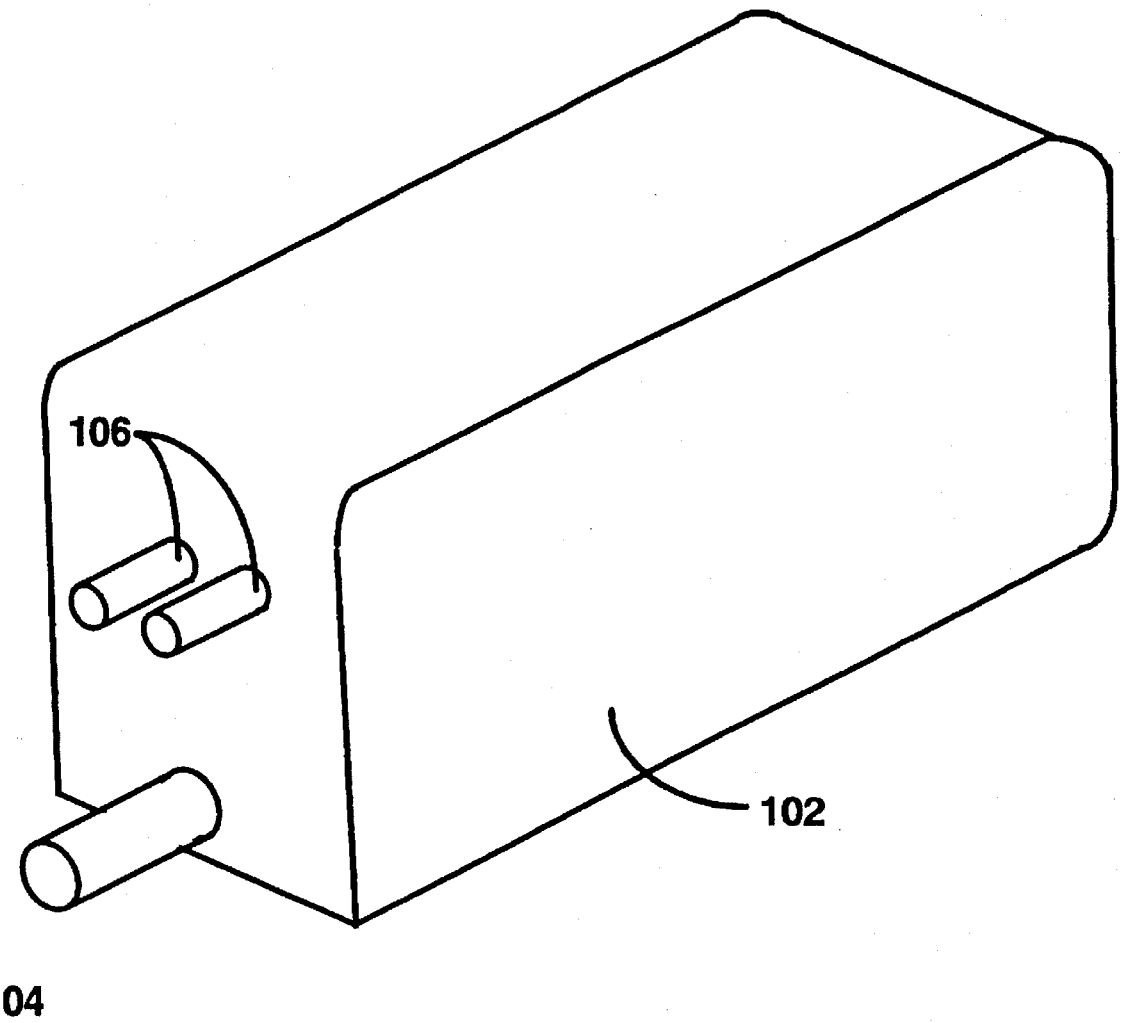
FIG. 1 is a diagram of a prior art liner.

Referring to FIG. 1, this figure shows a prior art liner 102 suitable for use with a container. Tubes 106 provide access to load/vent liner 102. Discharge tube 104 is located at the bottom of the rear wall of liner 102 to facilitate unloading through pumping or tilt mechanisms.

Figure 2:
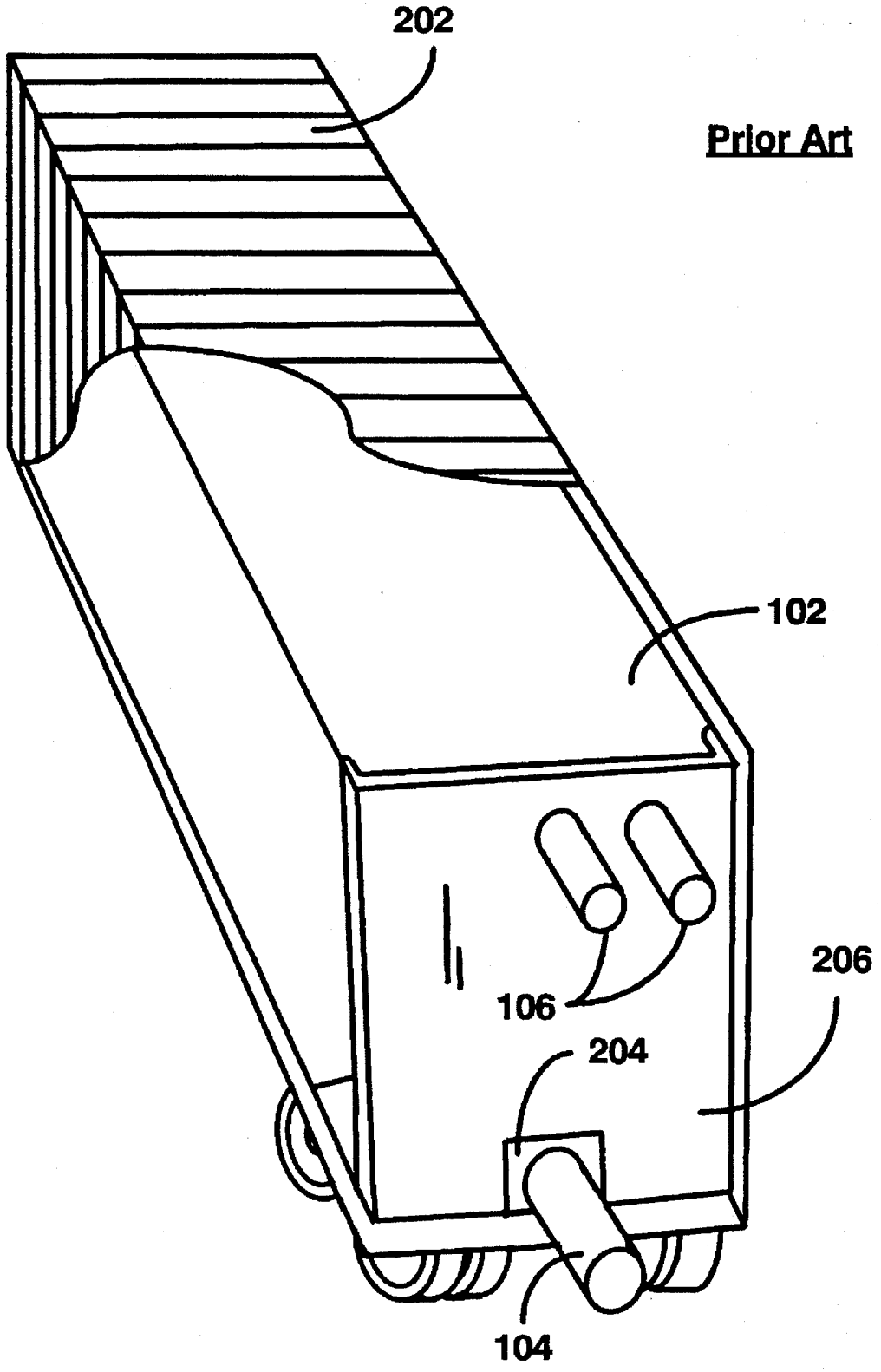
FIG. 2 is a diagram of a container with a prior art liner and bulkhead installed.

FIG. 2 is a prior art liner 102 shown installed in a container 202. In addition, a bulkhead 206 is shown mounted at the rear of liner 102 to provide support to liner 102. Discharge port 204 provides an opening for discharge tube 104.

Figure 3:
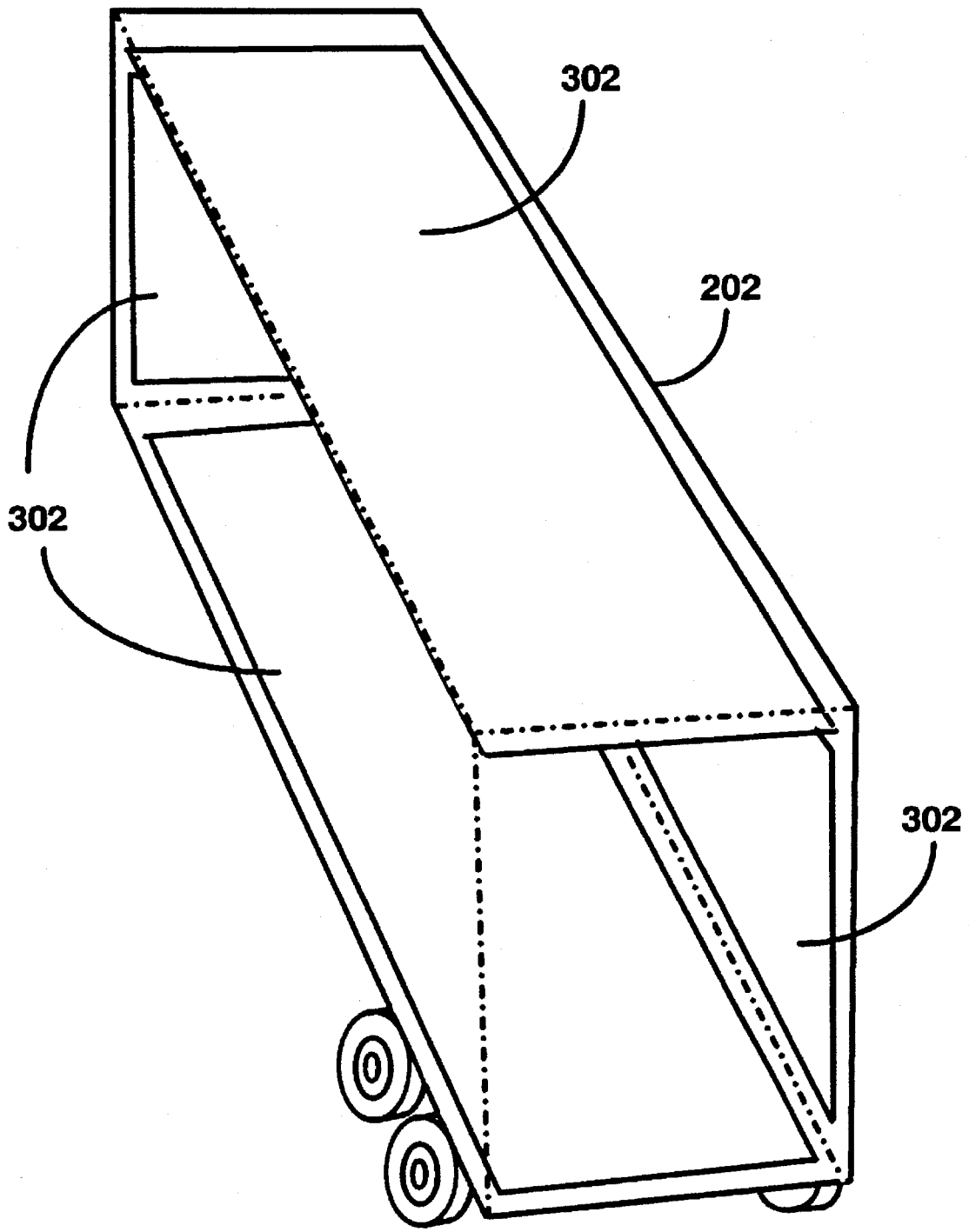
FIG. 3 is a diagram showing the location of one or more humidity control panel(s) in an unlined container.

FIG. 3 shows a humidity control panel 302 attached to the ceiling of the container as used in the preferred embodiment of the present invention. For ease of illustration, the suspension method used by the invention is omitted from this figure to better illustrate the placement of humidity control panel 302 in container 202. Those skilled in the art will recognize that a variety of suspension methods can be used, including directly attaching humidity control panel 302 to the ceiling of container 202 with adhesives or through existing lash rings. As can be seen, by locating the humidity control panel 302 near the ceiling of container 202, it does not interfere with the loading and unloading process. This allows the cargo to be unloaded more quickly and efficiently.

While the preferred embodiment places humidity control panel 302 near the ceiling of the container, additional embodiments in which the humidity control panels 302 are installed on the floor, side wall and/or rear wall are also possible, as illustrated in FIG. 3. Depending on the nature of the cargo and the severity of the climate, combinations of any or all of the above embodiments may be used to maintain better control of the environment inside the container.

Since the humidity control panel 302 is above the cargo, it does not pose the contamination risk that the use of loose desiccant bags present since the possibility of damage is greatly reduced. Another advantage associated with the use of the humidity control panel 302 is that the distribution of humidity control is more uniform since the humidity control panel 302 covers a substantial portion of the container ceiling. Those skilled in the arts will recognize that while the preferred embodiment envisions a large humidity control panel which occupies a substantial portion of the container 202 ceiling area, the humidity control panel 302 can be implemented in any convenient size which is suitable for a particular cargo. Also, humidity control panels 302 can be installed on one or more walls or floor of the container to allow more control of humidity in severe conditions and where the cargo type permits.

In addition to the foregoing, the location of humidity control panel 302 provides another significant advantage in that since it does not come in contact with the cargo, it can be saturated prior to loading the cargo which in turn allows water vapor to slowly release into the air resulting in an increase in humidity. This avoids problems associated with rot which would occur if moistened desiccant bags were placed directly into cargo as discussed above.

Figure 4:
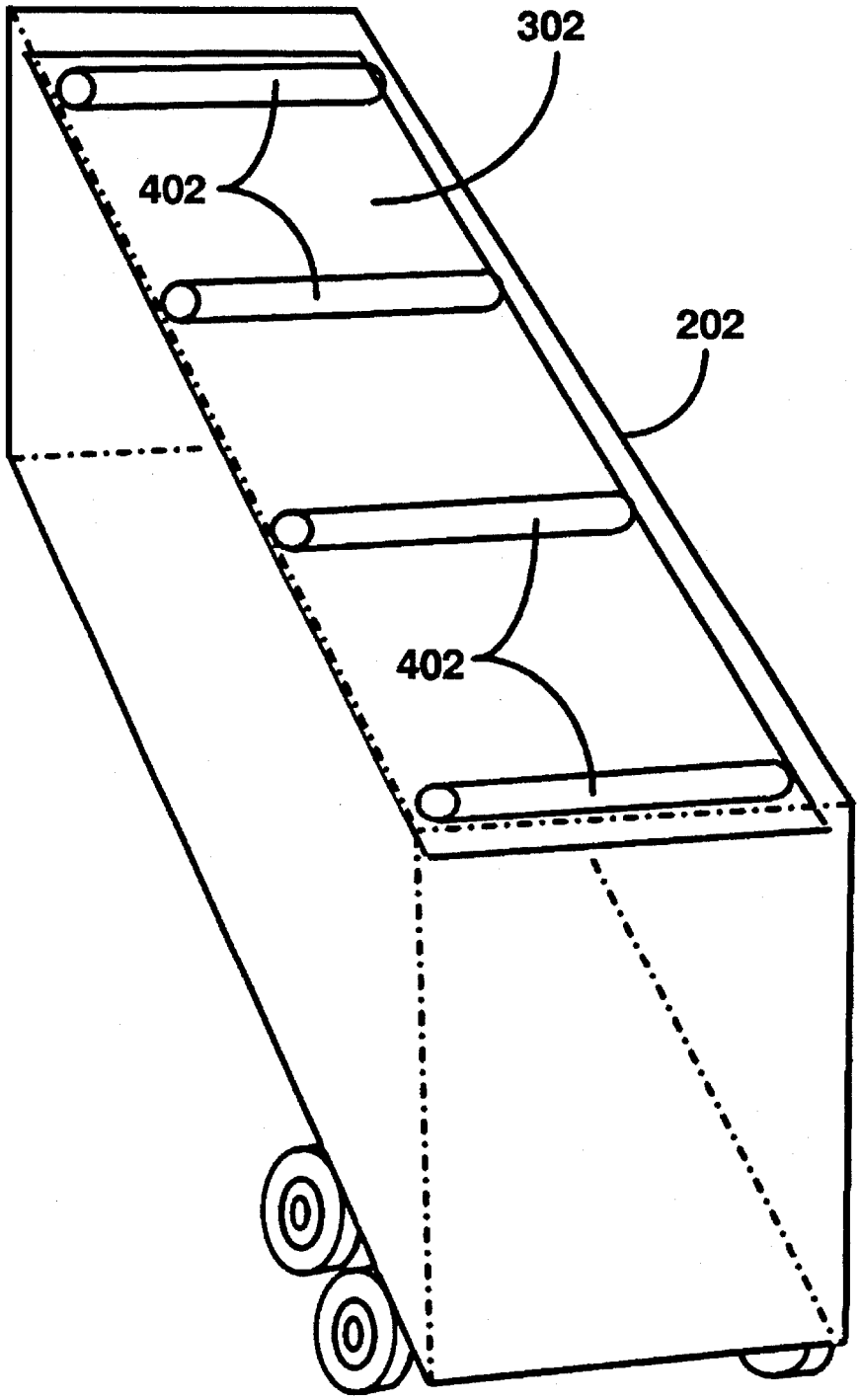
FIG. 4 is a preferred embodiment showing a method of suspending humidity control panel(s) in a container with sleeves.

FIG. 4 illustrates a preferred embodiment of suspending the humidity control panel 302 inside of container 202. In this embodiment, sleeves 402 are sealed to one side of humidity control panel 302. Sleeves 402 can be attached by any number of known means, such as sewing, heat sealing, adhesives, etc. The attachment method selected will depend on the type of material used for the backing of humidity control panel 302 and the material used to manufacture sleeves 402.

Sleeves 402 are designed to allow humidity control panel(s) 302 to be quickly and easily installed prior to loading the cargo. The sleeves 402 provide the ability to use quick disconnect attachment methods, such as the sleeve support rod 502 discussed in reference to FIG. 5, which allow a humidity control panel 302 to be installed in a minimum amount of time.

In an alternative embodiment, sleeve 402 is hollowed out and filled with water. The water is used as a reservoir to keep the humidity control panels 302 moist where extreme evaporation may be a problem.

Figure 5:
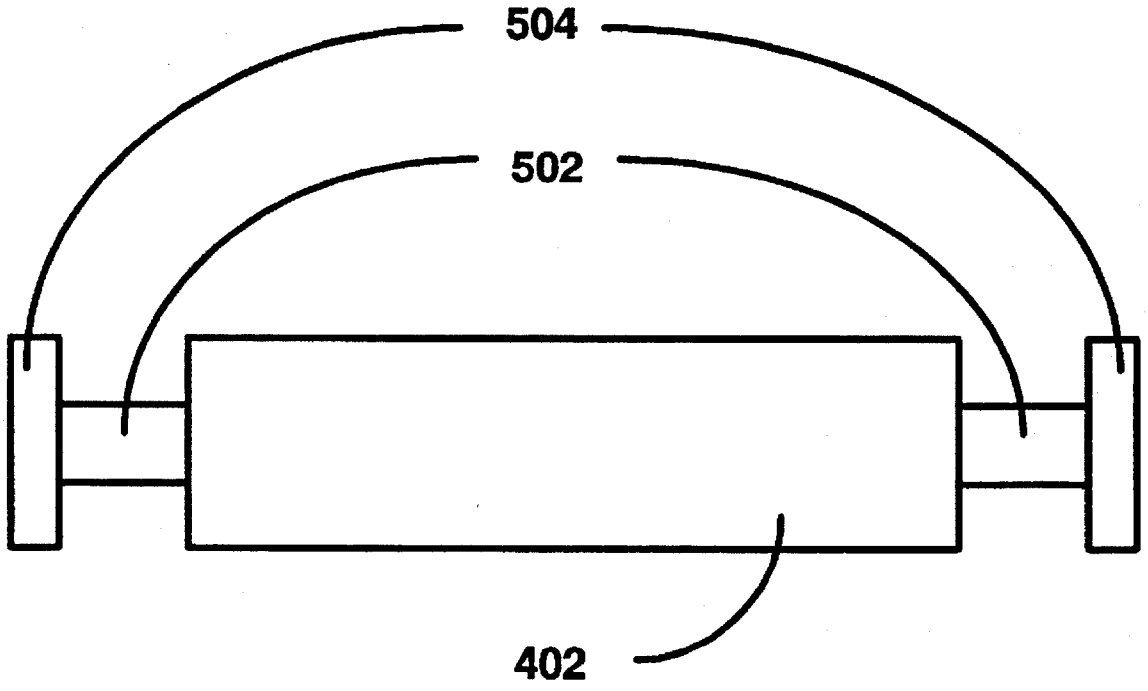
FIG. 5 is a preferred embodiment of a support rod for use with the humidity control panel.

FIG. 5 is a preferred embodiment of a sleeve support rod 502 used in conjunction with sleeve 402. Sleeve support rod 502 is designed to slide inside of support rod 502. In this embodiment, sleeve support rod 502 is intended to be a telescoping device which can be spring loaded or otherwise adjustable to allow sleeve support rod 502 to be secured under pressure between two opposing walls of container 202. Grip pads 504 are located on the ends of sleeve support rod 502 and may be removable to facilitate insertion of sleeve support rod 502 into sleeve 402. Grip pads 504 are intended to have a non-slip surface, such as a rubberized material, to avoid movement of humidity control panel 302 once it is installed.

Those skilled in the art will recognize that any number of methods can be designed to hold a support rod 502 between two opposing walls, such as simply making a wall attached holder, etc. However, an advantage of this embodiment is the ability to move the sleeve support rods 502 from vehicle to vehicle. Depending on the construction of container 202, the grip pads may be located against the container 202 wall, a wall brace (not shown) or against a board attached to the container 202 wall around the ceiling periphery.

Figure 6:
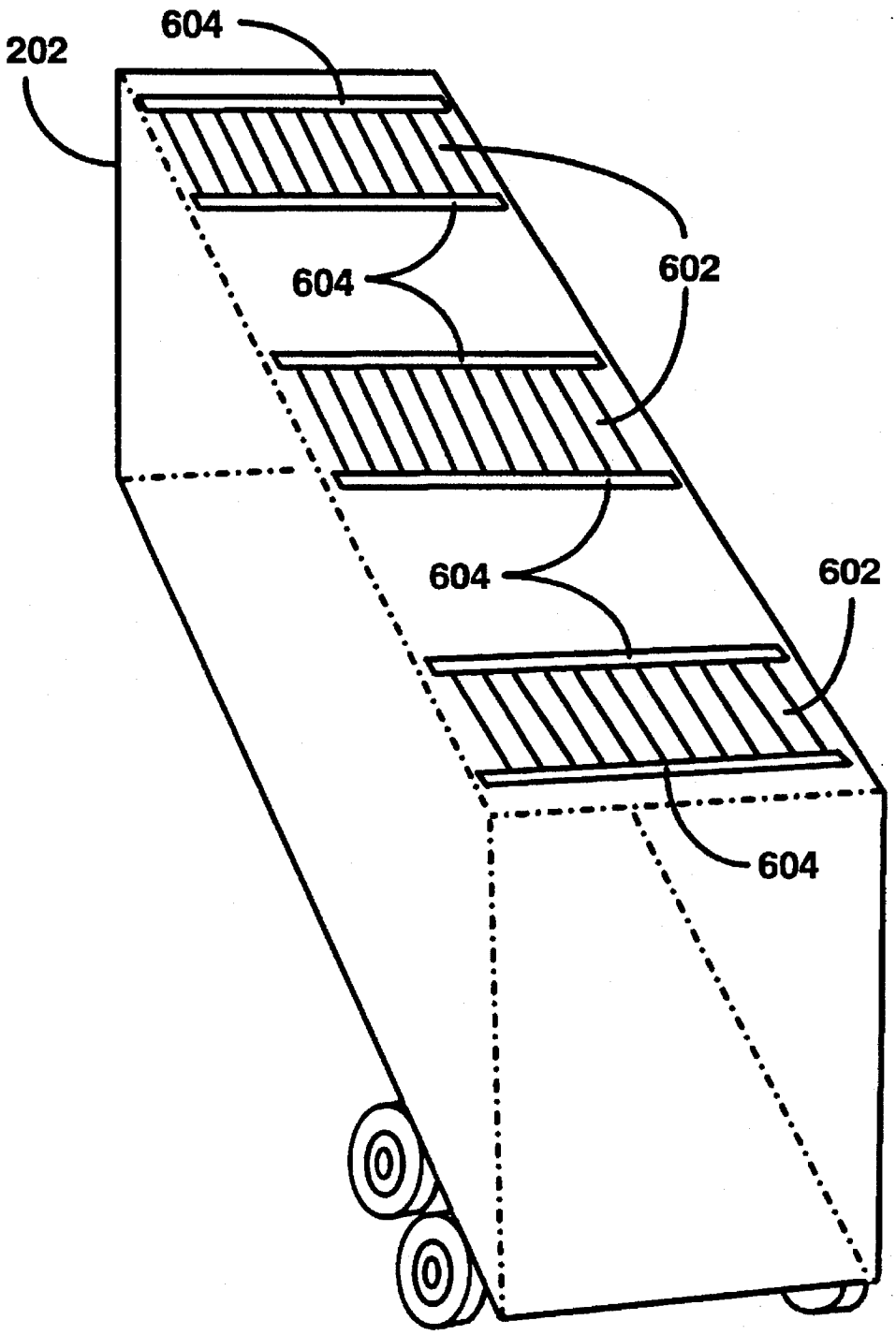
FIG. 6 is an alternative embodiment showing the humidity control panel implemented in the form of several removable panels.

FIG. 6 illustrates an alternative embodiment in which humidity control panel 602 is constructed from several independent sections. This method allows for easier handling during installation and removal since the components are smaller. In addition, the size of humidity control panel 602 can be easily varied to suit a particular cargo by merely using more or fewer of the smaller humidity control panels 602.

This embodiment shows a cutaway view of container 202 with humidity control panels 602 held in place by panel retainers 604. Those skilled in the art will recognize that panel retainers 604 can be implemented in a variety of ways. For example, they can be implemented by double sided adhesive which adheres humidity control panel 602 directly to the ceiling of container 202. Likewise, they can be mechanical brackets such as those commonly used to hold removable ceiling tiles.

Figure 7:
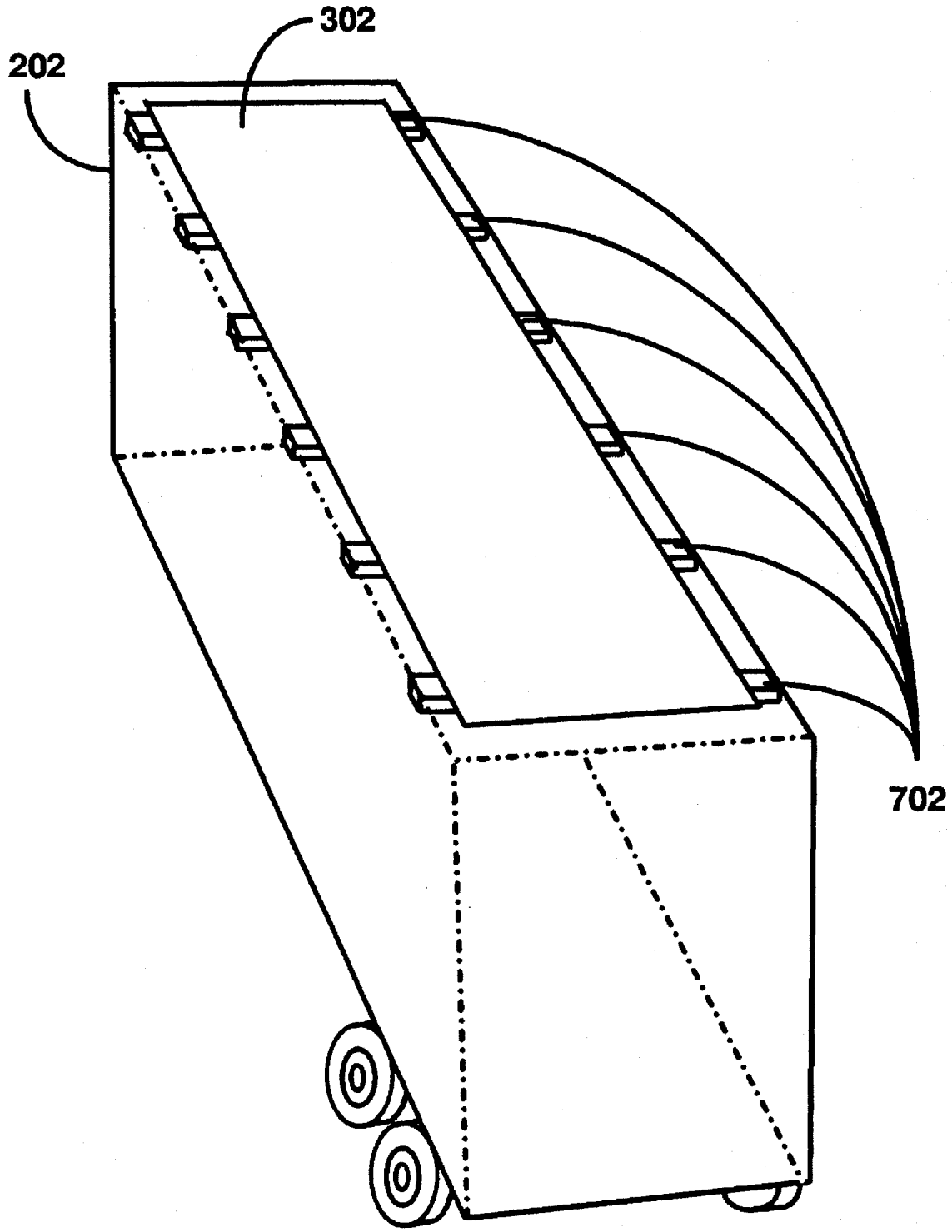
FIG. 7 is an alternative embodiment showing a method of suspending a humidity control panel in a container with cross bars.

FIG. 7 illustrates another embodiment in which the suspension method used to hold humidity control panel 302 uses boards 702 on which humidity control panel 302 is laid. Humidity control panel 302 can be secured to boards 702 by conventional means, such as stapling. Likewise, boards 702 can be inserted through sleeves 402 and then nailed or otherwise secured to the sides of container 202. For example, standard ISO rings in containers or trailer trucks.

Figure 8:
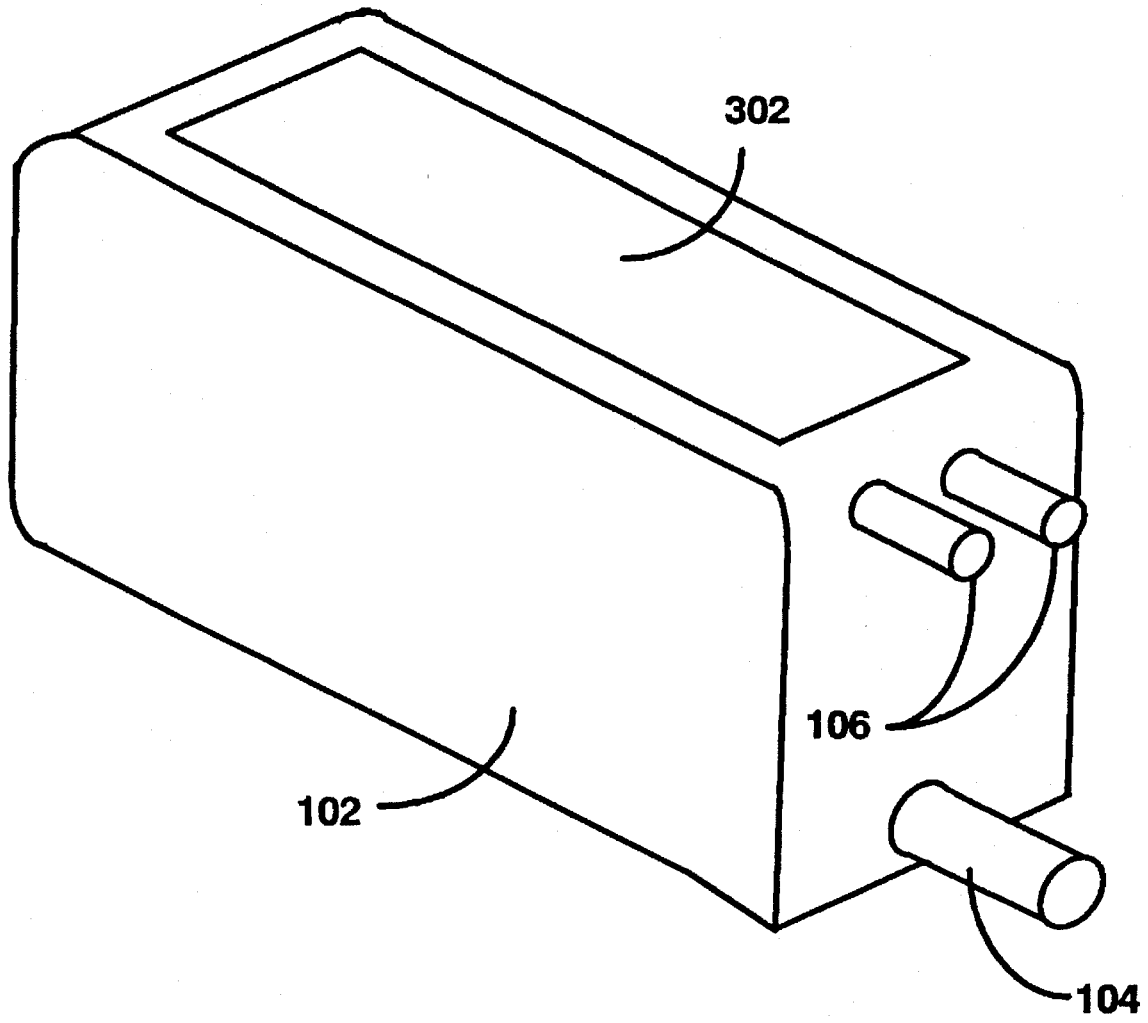
FIG. 8 is an alternative embodiment showing a method of integrating a humidity control panel in a liner.

Heretofore, the disclosure has concentrated on use of the humidity control panel 302 with a linerless container 202. It is also possible to implement the invention in a liner 102 environment. FIG. 8 is a preferred embodiment which integrates humidity control panel 302 into liner 102. In this embodiment, humidity control panel 302 is attached to the upper inside surface of liner 102. Attachment means can vary. For example, humidity control panel(s) 302 can be adhered to liner 102 by any suitable adhesive, it can be sewn to liner 102, it can be attached by ties (not shown) to tie holds (not shown), it can be heat sealed, etc. The method chosen would be determined by the particular material used for construction of liner 102 and humidity control panel 302, intended cargo type etc.

For ease of illustration, liner 102 is shown in completed and sealed form. Those skilled in the art will recognize that liner 102 must be open to install humidity control panel 302 and then sealed in the customary manner. Of course, liner 102 can come preinstalled with humidity control panel 302, but liner 102 would still have to be open at one end to facilitate preloading water in situations where humidity control panel 302 is used to increase humidity. An advantage of this embodiment is the convenience of having humidity control panel 302 installed without any additional labor cost.

Figure 9:
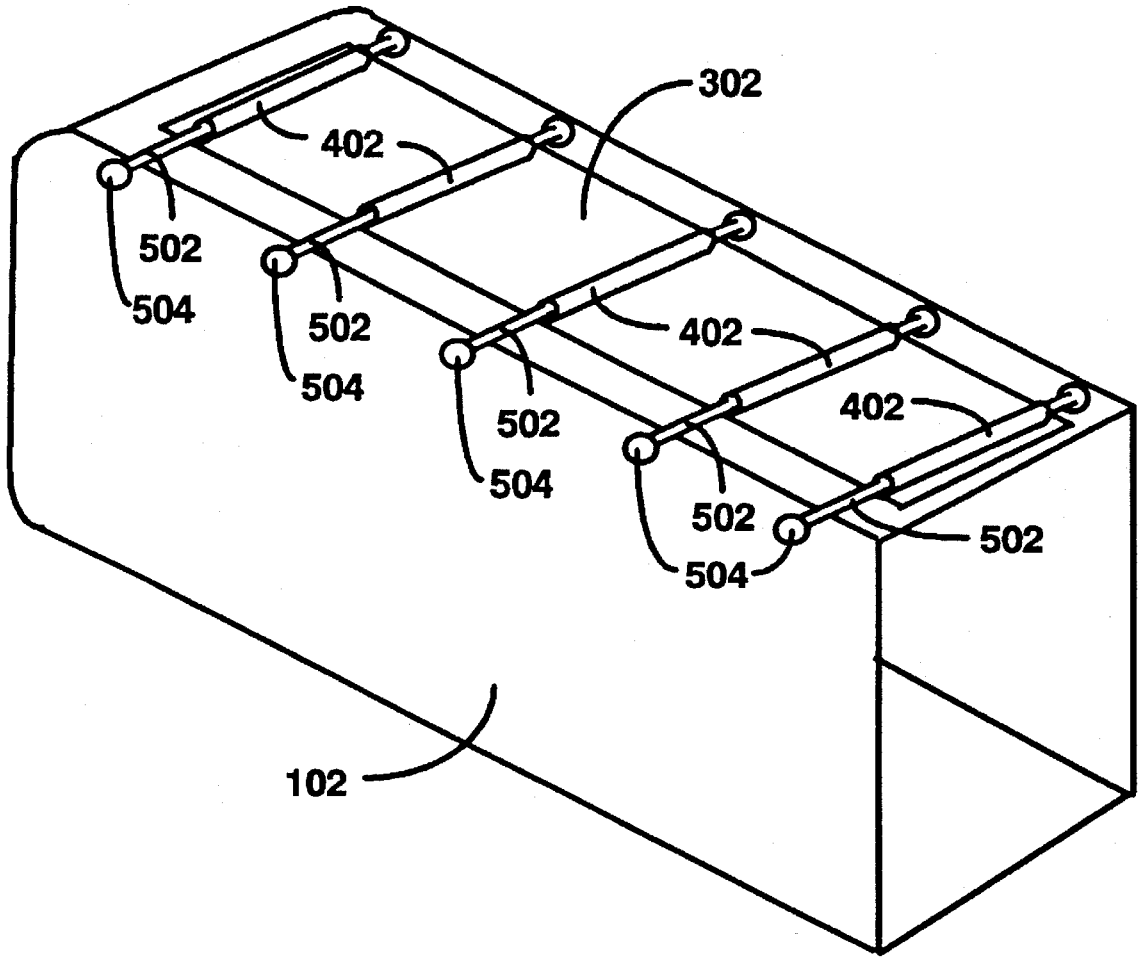
FIG. 9 is an alternative embodiment showing a method of installing a humidity control panel inside a liner.

FIG. 9 shows an alternative embodiment in which humidity control panel 302 is installed in a conventional liner 102. The illustrated embodiment uses sleeves 402 and sleeve support rods 502, as discussed above. In addition to being easily installable, this embodiment provides a further advantage in that the sleeve support rods 502 used to suspend humidity control panel 302 can simultaneously be used to hold liner 102 in an open position to facilitate loading and unloading. After liner 102 is loaded onto container 202 and humidity control panel(s) 302 is installed, liner 102 can be sealed in the customary manner.

While the invention has been described with respect to a preferred embodiment thereof, it will be understood by those skilled in the art that various changes in detail my be made therein without departing from the spirit, scope, and teaching of the invention. For example, the suspension mechanism may vary, the type of desiccant or other moisture absorbant materials can vary to suit particular cargo types, and methods of attaching humidity control panel 302 to liner 102 can vary. Accordingly, the invention herein disclosed is to be limited only as specified in the following claims.

I claim:

1. A humidity control apparatus for use with a cargo container, comprising:

at least one humidity control panel, the humidity control panel having an outer surface, at least a portion of the outer surface being a material permeable by water vapor, the outer surface sealed together such that at least one inner pocket is formed;

a desiccant material; the desiccant material secured inside the inner pocket of the humidity control panel by the sealed outer surface;

suspension means to hold the humidity control panel against an inner surface of the cargo container such that the humidity control panel does not interfere with loading or unloading of cargo, the suspension means further comprising:

at least one sleeve, the sleeve attached to a surface of the humidity control panel and further having at least two apertures and an inside diameter suitable for insertion of a support rod; and at least one support rod, the support rod of sufficient strength to hold the weight of the humidity control panel, the support rod further sized such that it is removably attachable to the container; and the humidity control panel further having a sufficient quantity of desiccant to maintain the container at a reduced humidity level during transportation or storage of cargo.

2. An apparatus, as in claim 1, wherein the humidity control panel is formed from a plurality of independent removable panels.

3. A humidity control apparatus for use with a cargo container, comprising:

at least one humidity control panel, the humidity control panel having an outer surface, at least a portion of the outer surface being a material permeable by water vapor, the outer surface sealed together such that at least one inner pocket is formed;

a desiccant material; the desiccant material secured inside the inner pocket of the humidity control panel by the sealed outer surface;

suspension means to hold the humidity control panel against an inner surface of the cargo container such that the humidity control panel does not interfere with loading or unloading of cargo, the suspension means further comprising:

at least one sleeve, the sleeve attached to a surface of the humidity control panel and further having at least two apertures and an inside diameter suitable for insertion of a support rod;

at least one support rod, the support red of sufficient strength to hold the weight of the humidity control panel, the support rod sized such that it is removably attachable to the container, the support rod further comprising a telescoping shaft, the shaft having an unextended length short enough to allow placement within the inner walls of the container, and an extended length long enough to engage at least two opposing walls of the container under pressure, and further having means to maintain the shaft length such that the shaft is in pressure contact with the two opposing walls of the container;

the humidity control panel further having a sufficient quantity of desiccant to maintain the container at a reduced humidity level during transportation or storage of cargo; and grips pads at each end of the telescoping shaft.

4. A humidity control apparatus for use with a cargo container, comprising;

at least one humidity control panel, the humidity control panels having an outer surface, at least a portion of the outer surface being a material permeable by water vapor, the outer surface sealed together such that at least one inner pocket is formed;

a desiccant material; the desiccant material secured inside the inner pocket of the humidity control panel by the sealed outer surface;

suspension means to hold the humidity control panel against an inner surface of the cargo container such that the humidity control panel does not interfere with loading or unloading of cargo, the suspension means further comprises a plurality of cross members secured to the container such that the humidity control panel rests on top of cross members and is secured to at least one of the cross members; and the humidity control panel further having a sufficient quantity of desiccant to maintain the container at a reduced humidity level during transportation or storage of cargo.

5. A humidity control apparatus for use with a cargo container, comprising:

at least one humidity control panel, the humidity control panel having an outer surface, at least a portion of the outer surface being a material permeable by water vapor, the outer surface sealed together such that at least one inner pocket is formed;

a desiccant material; the desiccant material secured inside the inner pocket of the humidity control panel by the sealed outer surface, the desiccant material capable, when preloaded with water, to slowly release water vapor such that the water vapor passes through the permeable portion of the outer layer and increases the humidity in the container, the humidity control panel further having a sufficient quantity of desiccant to maintain the container at an elevated humidity level during transportation or storage of cargo; and suspension means to hold the humidity control panel against an inner surface of the cargo container such that the humidity control panel does not interfere with loading or unloading of cargo, the suspension means further comprising;

at least one sleeve, the sleeve attached to a surface of the humidity control panel and further having at least two apertures and an inside diameter suitable for insertion of a support rod; and at least one support rod, the support rod of sufficient strength to hold the weight of the humidity control panel, the support rod further sized such that it is removably attachable to the container.

6. An apparatus, as in claim 5, wherein the humidity control panel is formed from a plurality of independent removable panels.

7. A humidity control apparatus for use with a cargo container, comprising:

at least one humidity control panel, the humidity control panel having an outer surface, at least a portion of the outer surface being a material permeable by water vapor, the outer surface sealed together such that at least one inner pocket is formed;

a desiccant material; the desiccant material secured inside the inner pocket of the humidity control panel by the sealed outer surface, the desiccant material capable, when preloaded with water, to slowly release water vapor such that the water vapor passes through the permeable portion of the outer layer and increases the humidity in the container, the humidity control panel further having a sufficient quantity of desiccant to maintain the container at an elevated humidity level during transportation or storage of cargo; and suspension means to hold the humidity control panel against an inner surface of the cargo container such that the humidity control panel does not interfere with loading or unloading of cargo, the suspension means further comprising at last one sleeve, the sleeve attached to a surface of the humidity control panel and further having at least two apertures and an inside diameter suitable for insertion of a support rod; and at least one support rod, the support rod of sufficient strength to hold the weight of the humidity control panel, the support rod further sized such that it is removably attachable to the container, the support rod further comprising a telescoping shaft, the shaft having an unextended length short enough to allow placement within the inner walls of the container, and an extended length long enough to engage at least two opposing walls of the container under pressure, and further having means to maintain the shaft length such that the shaft is in pressure contact with the two opposing walls of the container; and grips pads at each end of the telescoping shaft.

8. A humidity control apparatus for use with a cargo container, comprising;

at least one humidity control panel, the humidity control panel having an outer surface, at least a portion of the outer surface being a material permeable by water vapor, the outer surface sealed together such that at least one inner pocket is formed;

a desiccant material; the desiccant material secured inside the inner pocket of the humidity control panel by the sealed outer surface, the desiccant material capable, when preloaded with water, to slowly release water vapor such that the water vapor passes through the permeable portion of the outer layer and increases the humidity in the container, the humidity control panel further having a sufficient quantity of desiccant to maintain the container at an elevated humidity level during transportation or storage of cargo; and suspension means to hold the humidity control panel against an inner surface of the cargo container such that the humidity control panel does not interfere with loading or unloading of cargo, the suspension means further comprises a plurality of cross members secured to the container such that the humidity control panel rests on top of cross members and is secured to at least one of the cross members.

9. A humidity control apparatus for use with a cargo container, comprising:

at least one humidity control panel, the humidity control panel having an outer surface, at least a portion of the outer surface being a material permeable by water vapor, the outer surface sealed together such that at least one inner pocket is formed;

a desiccant material; the desiccant material secured inside the inner pocket of the humidity control panel by the sealed outer surface, the desiccant material capable when loaded into the container in a dry state of reducing humidity in the container by absorbing water vapor, and when preloaded with water, to slowly release water vapor such that the water vapor passes through the permeable portion of the outer layer and increases the humidity in the container; and suspension means to hold the humidity control panel against an inner surface of the cargo container such that the humidity control panel does not interfere with loading or unloading of cargo, the suspension means further comprising;

at least one sleeve, the sleeve attached to a surface of the humidity control panel and further having at least two apertures and an inside diameter suitable for insertion of a support rod; and at least one support rod, the support rod of sufficient strength to hold the weight of the humidity control panel, the support rod further sized such that it is removably attachable to the container.

10. A humidity control apparatus for use with a cargo container, comprising:

at least one humidity control panel, the humidity control panel having an outer surface, at least a portion of the outer surface being a material permeable by water vapor, the outer surface sealed together such that at least one inner pocket is formed;

a desiccant material; the desiccant material secured inside the inner pocket of the humidity control panel by the sealed outer surface, the desiccant material capable when loaded to the container in a dry state of reducing humidity in the container by absorbing water vapor, and then preloaded with water, to slowly release water vapor such that the water vapor passes through the permeable portion of the outer layer and increases the humidity in the container; and suspension means to hold the humidity control panel against an inner surface of the cargo container such that the humidity control panel does not interfere with loading or unloading of cargo, the suspension means further comprising:

at least one sleeve, the sleeve attached to a surface of the humidity control panel and further having at least two apertures and an inside diameter suitable for insertion of a support rod; and at least one support rod, the support rod of sufficient strength to hold the weight of the humidity control panel, the support rod further sized such that it is removably attachable to the container, the support rod further comprising a telescoping shaft, the shaft having an unextended length short enough to allow placement within the inner walls of the container, and an extended length long enough to engage at least two opposing walls of the container under pressure, and further having means to maintain the shaft length such that the shaft is in pressure contact with the two opposing walls of the container; and grips pads at each end of the telescoping shaft.

11. A liner system for a cargo container, comprising:

a liner;

a humidity control apparatus for attachment to the inside of the liner, the humidity control apparatus further comprising:

at least one humidity control panel, the humidity control panel having an outer surface, at least a portion of the outer surface being a material permeable by water vapor, the outer surface sealed together such that at least one inner pocket is formed;

a desiccant material; the desiccant material secured inside the inner pocket of the humidity control panel by the sealed outer surface; and suspension means to attach the humidity control panel to the inside of the liner substantially adjacent to an inner surface of the liner, such that the humidity control panel is held in place in the liner and does not interfere with loading or unloading of cargo.

12. A liner system, as in claim 11, wherein the suspension means further comprises an adhesive to adhere the humidity control panel to the liner.

13. A liner system, as in claim 12, wherein the desiccant material is capable when loaded into the container in a dry state of reducing humidity in the container.

14. A liner system, as in claim 12, wherein the desiccant material is capable when preloaded with water, to slowly release water vapor such that the water vapor passes through the permeable portion of the outer layer and increases the humidity in the container.

15. A liner system, as in claim 12, wherein the desiccant material is capable when loaded into the container in a dry state of reducing humidity in the container, and when preloaded with water, to slowly release water vapor such that the water vapor passes through the permeable portion of the outer layer and increases the humidity in the container.

16. A liner system, as in claim 11, wherein the suspension means further comprises a plurality of ties to attach the humidity control panel to the liner.

17. A liner system, as in claim 16, wherein the desiccant material is capable when loaded into the container in a dry state of reducing humidity in the container.

18. A liner system, as in claim 16, wherein the desiccant material is capable when preloaded with water, to slowly release water vapor such that the water vapor passes through the permeable portion of the outer layer and increases the humidity in the container.

19. A liner system, as in claim 16, wherein the desiccant material is capable when loaded into the container in a dry state of reducing humidity in the container, and when preloaded with water, to slowly release water vapor such that the water vapor passes through the permeable portion of the outer layer and increases the humidity in the container.

20. A liner system for a cargo container, comprising:

a liner;

a humidity control apparatus, the humidity control apparatus further comprising:

at least one humidity control panel, the humidity control panel having an outer surface, at least a portion of the outer surface being a material permeable by water vapor, the outer surface sealed together such that at least one inner pocket is formed;

a desiccant material; the desiccant material secured inside the inner pocket of the humidity control panel by the sealed outer surface; and suspension means to attach the humidity control panel to the liner substantially adjacent to an inner surface of the liner, such that the humidity control panel is held in place in the liner and does not interfere with loading or unloading of cargo, the suspension means further comprising:

at least two sleeves, the sleeves attached to the humidity control panel on a first side of the sleeve such that the opening in the sleeves face opposite walls of the container; and at least two support rods, the support rods of sufficient strength to hold the weight of the humidity control panel, the support rods positioned inside the sleeve and sized such that they are removably attachable to the container walls, the support rods further placed substantially near the upper surface of the liner such that the support rods hold the humidity control panel in position inside the liner bag and hold liner in position inside the container to facilitate loading and unloading.

21. A liner system, as in claim 20, wherein the desiccant material is capable when loaded into the container in a dry state of reducing humidity in the container.

22. An apparatus, as in claim 21, wherein the support rod further comprises:

a telescoping shaft, the shaft having an unextended length short enough to allow placement within the inner walls of the container, and an extended length long enough to engage at least two opposing walls of the container under pressure, and further having means to maintain the shaft length such that the shaft is in pressure contact with the two opposing walls of the container; and grips pads at each end of the telescoping shaft.

23. A liner system, as in claim 20, wherein the desiccant material is capable when preloaded with water, to slowly release water vapor such that the water vapor passes through the permeable portion of the outer layer and increases the humidity in the container.

24. An apparatus, as in claim 23, wherein the support rod further comprises:

a telescoping shaft, the shaft having an unextended length short enough to allow placement within the inner walls of the container, and an extended length long enough to engage at least two opposing walls of the container under pressure, and further having means to maintain the shaft length such that the shaft is in pressure contact with the two opposing walls of the container; and grips pads at each end of the telescoping shaft.

25. A liner system, as in claim 20, wherein the desiccant material is capable when loaded into the container in a dry state of reducing humidity in the container, and when preloaded with water, to slowly release water vapor such that the water vapor passes through the permeable portion of the outer layer and increases the humidity in the container.

26. An apparatus, as in claim 25, wherein the support rod further comprises:

a telescoping shaft, the shaft having an unextended length short enough to allow placement within the inner walls of the container, and an extended length long enough to engage at least two opposing walls of the container under pressure, and further having means to maintain the shaft length such that the shaft is in pressure contact with the two opposing walls of the container; and grips pads at each end of the telescoping shaft.

* * * * *